US006148760A

United States Patent [19]

Oi

[11] Patent Number: 6,148,760

[45] Date of Patent: Nov. 21, 2000

[54] EXTENDIBLE PARKING GUIDE WITH OVERHEAD TRACK

[76] Inventor: Steve Oi, 1590 Portsmouth Ct., Grayslake, Ill. 60030

[21] Appl. No.: 09/226,280

[22] Filed: Jan. 7, 1999

[51] Int. Cl.[7] ..... B60S 13/00

[52] U.S. Cl. ..... 116/28 R; 40/617; 248/317; 248/343

[58] Field of Search ..... 248/317, 343, 248/322, 327, 339; 116/28 R; 33/264; 40/601, 603, 606, 610, 617

[56] References Cited

U.S. PATENT DOCUMENTS

| | | | |
|---|---|---|---|
| 824,222 | 6/1906 | Warren | 439/478 |
| 4,341,488 | 7/1982 | Ryan | 404/10 |
| 5,230,296 | 7/1993 | Glitz et al. | 116/28 R |
| 5,297,500 | 3/1994 | Wilson | 116/28 R |
| 5,329,874 | 7/1994 | Posey | 116/222 |
| 5,474,016 | 12/1995 | Haney | 116/28 R |

*Primary Examiner*—Andrew H. Hirshfeld
*Assistant Examiner*—R. Alexander Smith

[57] ABSTRACT

The extendible parking guide with overhead track is an improved parking guide device for positioning a motor vehicle in an enclosed garage or similar parking area. The extendible parking guide includes a set of varying length rods which can be assembled into a longer rod device of various lengths. The top section of the extendible parking guide features a hook. The bottom section of the extendible parking guide is brightly colored for easy visibility. The extendible parking guide is hung from an overhead track which is fastened to the ceiling of the garage above a vehicle's windshield. The overhead track contains numerous openings along its length which allow the parking guide to be hung in different lateral positions, so that the parking guide makes contact with the windshield of the vehicle. When assembled and installed correctly, the parking guide serves as a location marker for the driver of a motor vehicle, indicating when the driver's vehicle is parked in the desired position when the vehicle's windshield touches the bottom of the parking guide.

5 Claims, 4 Drawing Sheets

EXTENDIBLE PARKING GUIDE WITH OVERHEAD TRACK

BACKGROUND OF THE INVENTION

My invention relates to an extendible parking guide with an overhead track which provides a visual guide for positioning a motor vehicle in an enclosed garage or similar parking area.

The challenge of parking a motor vehicle such h as a passenger automobile, a minivan or sport utility vehicle (SUV), in an enclosed garage is faced by millions of drivers every day. The size of the typical residential garage and the amount of space available for parking vehicles is usually limited, and parking often requires some degree of precision. The penalty for improperly parking a vehicle may be damage to the vehicle, the garage's walls or door, or even injury to the driver and/or passengers.

Numerous solutions to the parking challenge have been devised, ranging from the simple to the complex. Home-grown solutions, such as tying a tennis ball or ping pong ball to a string and dangling the ball from the ceiling, while simple, suffer from disadvantages:

a. mounting of the string to the ceiling of the garage is tricky, requiring trial and error to properly attach the string to the ceiling in the optimal location;

b. the string or ball may come loose or be accidentally tugged, making the system inaccurate as a location guide;

c. the ball connected to a string is often misinterpreted by children to be a toy and often invites them to play and damage the system;

d. the string and ball are sometimes assembled in a flimsy manner and may be easily damaged by wind or the wiper blades of a vehicle.

U.S. Pat. No. 5,230,296 (Glitz et al.) proposes a Retractable Parking Aid which is sturdier than ball and string systems, is somewhat easier to install and is adjustable. However, optimal placement on a garage's ceiling is still tricky, and the aid can be accidentally tugged, making the aid inaccurate as a location guide.

BRIEF SUMMARY OF THE INVENTION

My invention, an extendible parking guide with overhead track, offers several advantages:

a. The extendible parking guide can be assembled to varying lengths which can accommodate garages with ceilings of varying height and vehicles of varying height;

b. The extendible parking guide, once assembled by the user, stays a fixed length and is difficult to accidentally adjust, compared to ball and string systems or other systems;

c. The extendible parking guide is somewhat rigid, resisting damage caused by wind or windshield wipers;

d. The overhead track is installed on a garage's ceiling over a vehicle's windshield parallel to the length of the vehicle, and allows lateral positioning of the extendible parking guide, reducing the need for precision in attaching the parking guide to the ceiling;

e. The overhead track works together with the extendible parking guide to easily position the device so that it makes contact with a vehicle's windshield;

f. The extendible parking guide and the overhead track are easy to assemble and install;

g. The extendible parking guide and overhead track are simple in design and relatively easy and inexpensive to manufacture.

In accordance with the description presented here, other objectives and advantages of my invention will become apparent when the description and drawings are reviewed.

DETAILED DESCRIPTION OF THE INVENTION

Figure 1:
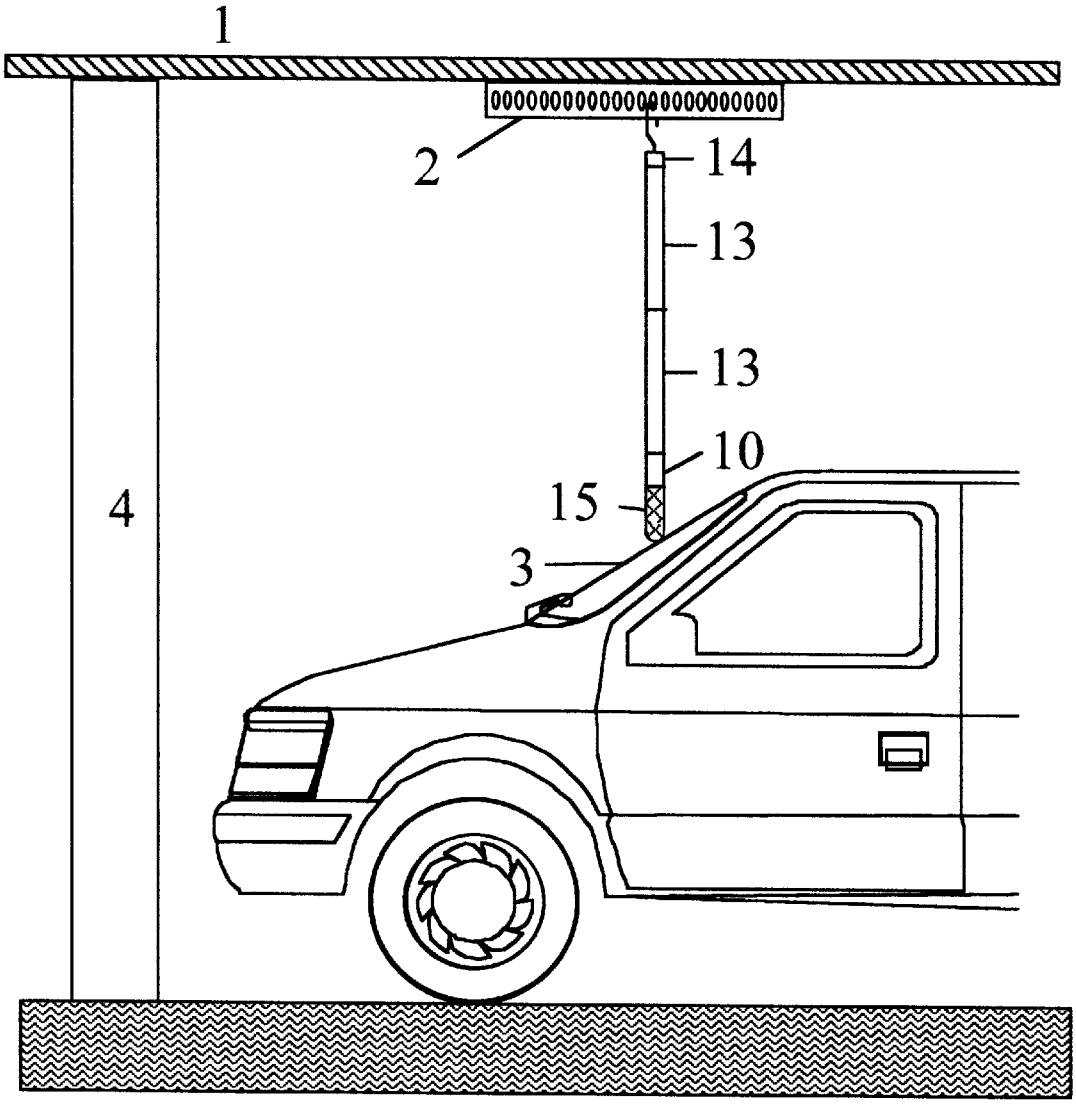
FIG. 1 is a side view of the extendible parking guide and overhead track showing a vehicle parked in the desired position, with the vehicle's windshield touching the bottom of the parking guide.
Figure 2:
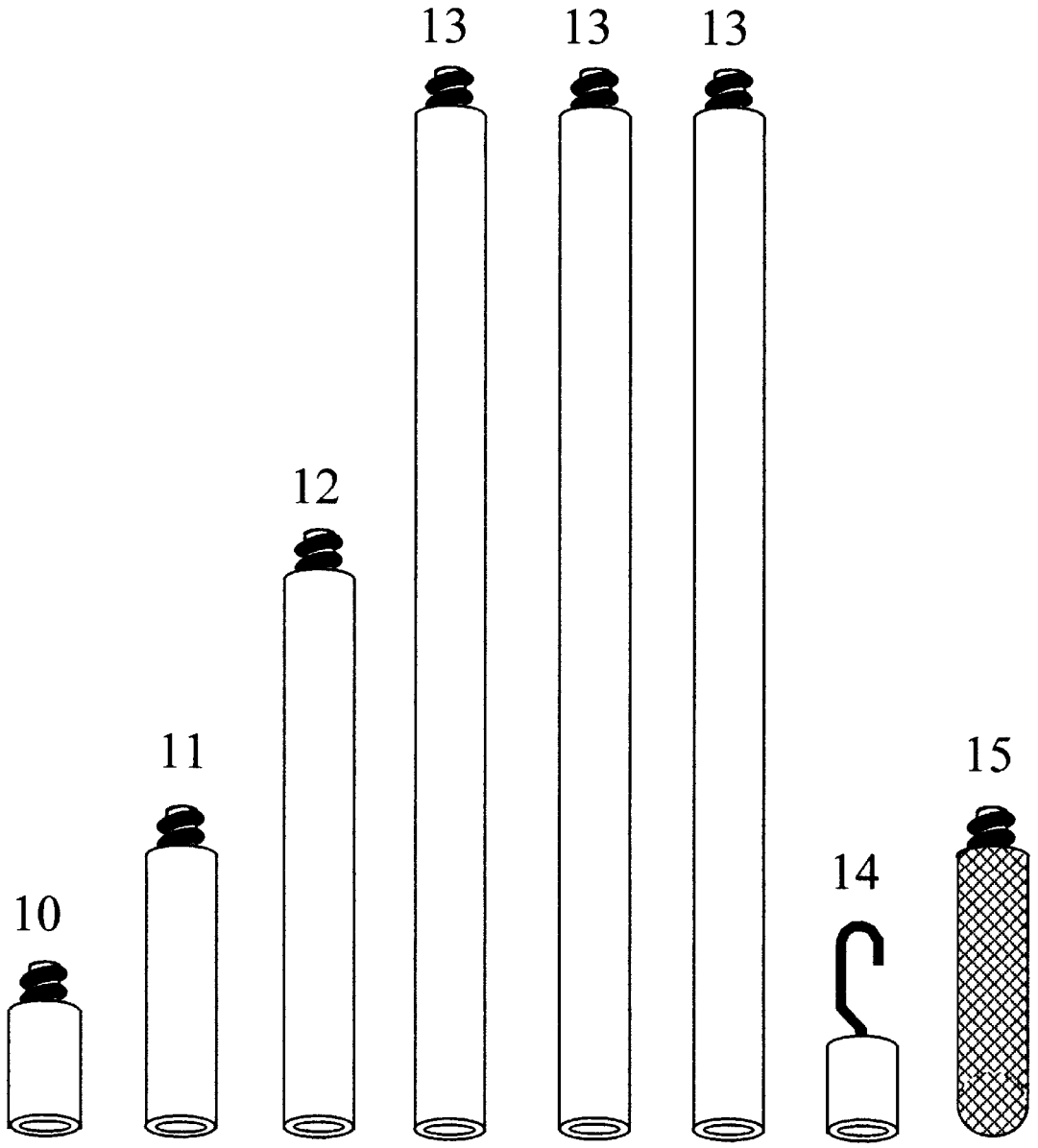
FIG. 2 shows the elements of the extendible parking guide consisting of a set of rods of varying lengths, a top hook section and a bottom rod section.
Figure 3:
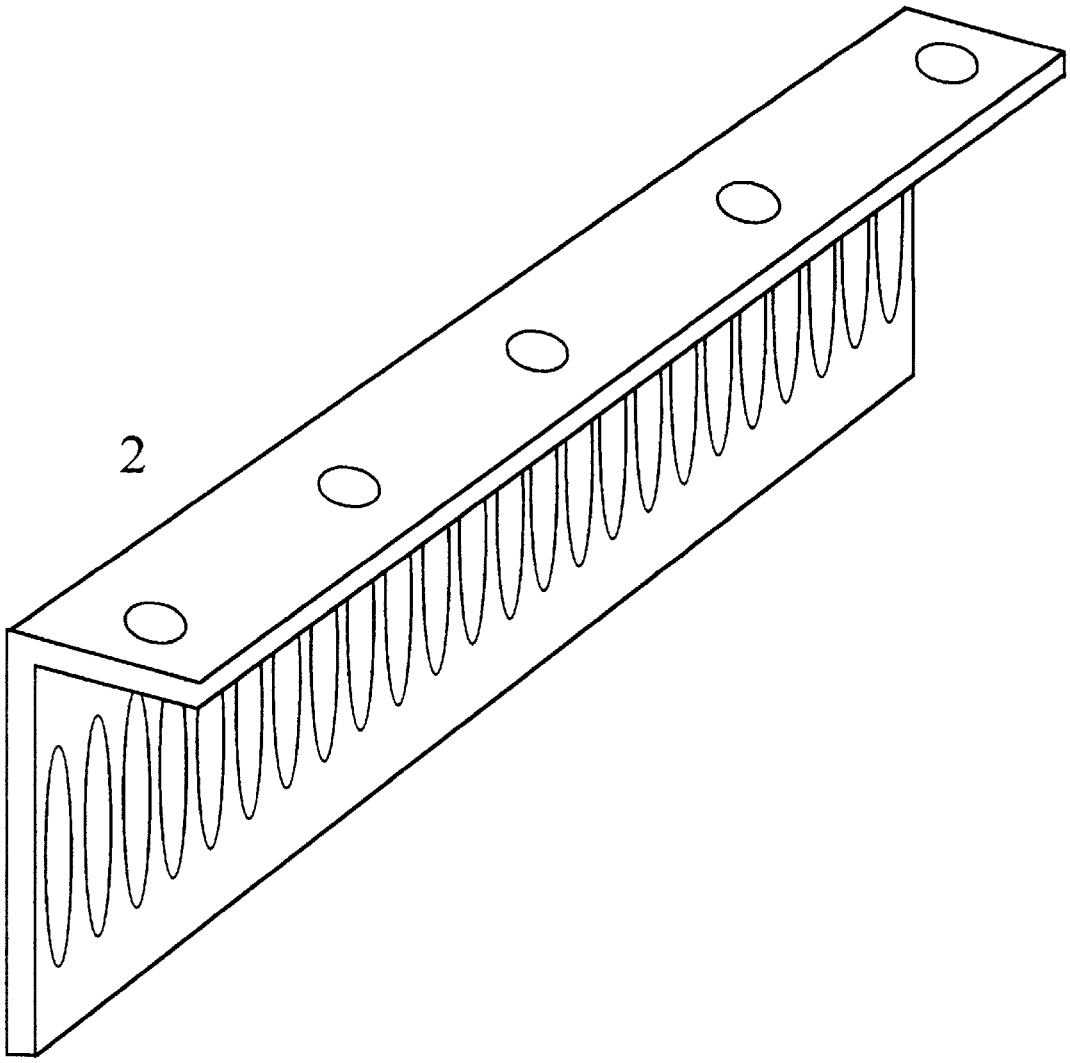
FIG. 3 is a side-angled view of the overhead track.
Figure 4:
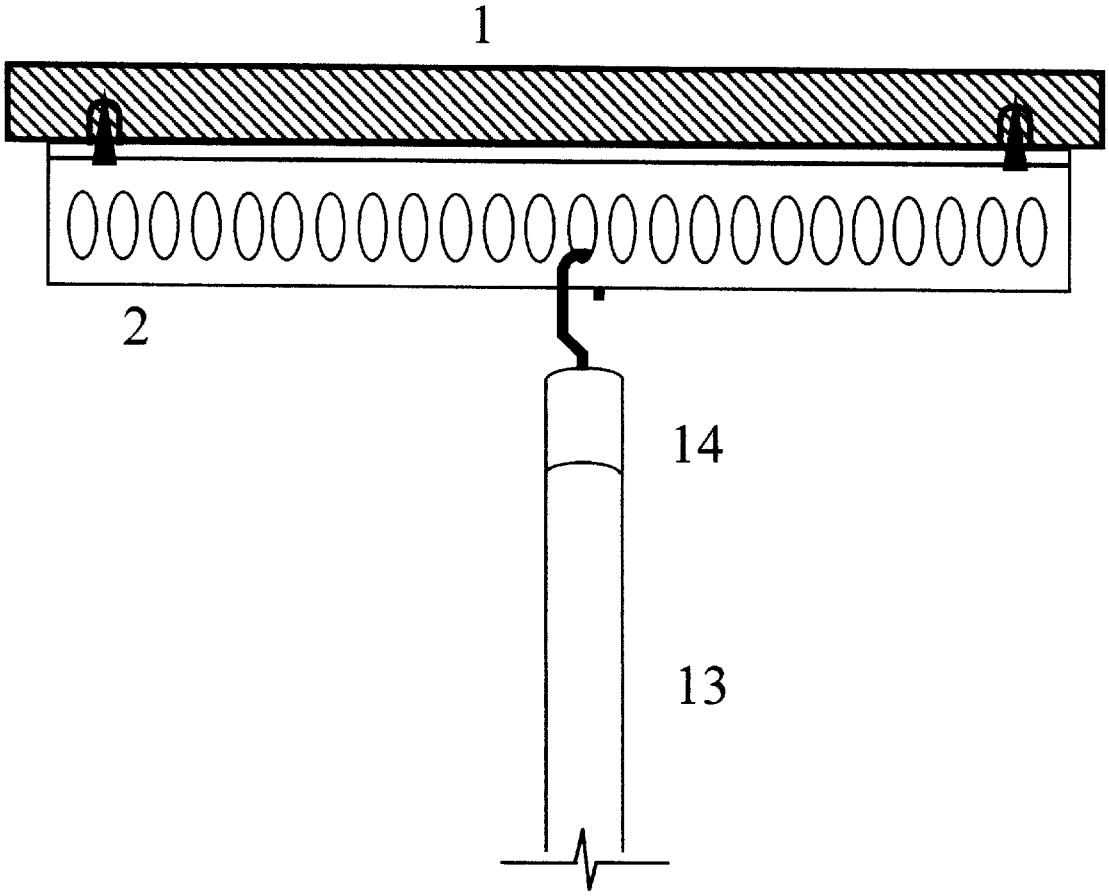
FIG. 4 is a side view of the overhead track and the extendible parking guide hooked to one of the track's hanging positions.

A typical embodiment of the extendible parking guide with overhead track is shown in FIG. 1. The extendible parking guide is a device which is assembled from a set of varying length rods, as shown in FIG. 2, a specially designed top hook section 14 and a bottom rod section 15. The extendible parking guide is suspended from the overhead track 2 which is attached to a garage's ceiling over a vehicle's windshield parallel to the vehicle's length, as shown in FIG. 1. The overhead track 2 contains numerous openings which serve as hanging positions, as shown in FIG. 3, and permits lateral positioning of the extendible parking guide, as shown in FIG. 4.

The set of varying length rods, as shown in FIG. 2, can accommodate garage ceilings ranging from 8 to 12 feet in height and vehicles ranging from 4 to 7 feet in height. The rods shown in FIG. 2 include:

1—3" rod 10

1—6" rod 11

1—12" rod 12

3—24" rods 13

1—top hook section 14 which is 4" in length

1—bottom rod section 15 which is 6" in length

The diameter of the rods can be ¾" to 1 ½". The rods and top hook section may be of a light or neutral color, such as white.

The top hook section 14, as shown in FIG. 2, is a specially designed cap which is assembled as the top-most section of the parking guide. This section has a hook which allows the parking guide to be hung from the overhead track 2, which is fastened to the ceiling of the garage, as shown in FIG. 4.

The bottom rod section 15, as shown in FIG. 2, is a specially designed section which is assembled as the bottom-most section of the parking guide. The bottom rod section is the part of the parking guide which is most visible to a driver and will be of a bright, highly visible color, such as red, and may also exhibit reflective qualities so that drivers can easily observe the bottom rod section when parking.

One or more rods, the top hook and bottom rod sections are assembled together to form the parking guide by screwing the ends of each rod or section together. Each rod, as shown in FIG. 2, has on one end a male set of threads and the other end a female set of threads. The male and female threads must be of a sufficient length and design so that connections are tight, yet removable if desired, and the rods when assembled create a relatively straight parking guide from end to end. The top hook section 14 has a female set of threads on one end and a hook on the other. The bottom rod section 15 has a male set of threads on one end and no threads on the other. Alternatively, the rods, top hook and bottom rod sections could employ an interlocking, snap-tight system of male and female ends, or a system which uses tubular couplers to connect sections, or some other system which easily connects the rods and top and bottom sections.

The overhead track 2 is a long, flat rectangular track approximately ¼" to ¼" in thickness, which is bent lengthwise in a 90 degree angle in the shape of an "L", as shown in FIG. 3. The length of the overhead track is approximately 24". The wider section (the long side of the "L") is approximately 2" in width. The shorter section (the short side of the "L" which is perpendicular to the longer side) is approximately 1" in width. The wider section will have elongated oval-shaped openings spaced evenly along the length of the track. Each opening is approximately ½" to ¾" wide and 1" high. The openings will permit the extendible parking guide to hang in a variety of positions along the length of the track. The shorter section of the track will have pre-drilled holes which will allow the overhead track to be fastened to the ceiling of a garage.

The rods, the top hook and bottom rod sections, and the overhead track can be constructed of plastic, wood, metal or some combination of materials which are somewhat lightweight, yet provide strength and rigidity.

One or more rods can be assembled to accommodate a range of lengths between a garage's ceiling and the windshield of a vehicle. For example, a garage that is 10 feet in height and a 1999 Toyota Camry sedan with an approximate height of 55" would require a device which is approximately 71" to 77" in length, including the height of the overhead track. The device would have to span the distance between the garage's ceiling and the top of the vehicle, plus a few inches for the bottom of the device to contact the vehicle's windshield. The distance between the garage ceiling and the height of a Toyota Camry is 65" (120" minus 55"). In order for the parking guide to contact a spot near or around the center of the windshield, the parking guide would need to be an additional 6" to 12" longer. Thus, the total length of the device for this vehicle would be approximately 71" to 77". A device assembled with two 24" rods, the 12" rod, the 3" rod, plus the top hook section which is 4", plus the height of the overhead track which is 2", and the bottom rod section would provide a total length of 75" (24"+24"+12"+3"+4"+2"+6").

Although the description above contains many specifics, these should not be construed as limiting the scope of the invention, but merely providing illustration of some of the presently preferred embodiments of this invention. For example, the rods may be manufactured of plastic, wood, metal or some combination of materials which provide strength and rigidity. The shape of the rods may be cylindrical or of a geometric design, such as hexagonal. They may be hollow or solid. Further, the means by which the rods are assembled together may be a system in which the rods are screwed together, or an interlocking system which connects the male end of one rod to the female end of another rod, or a system of couplers, or some other system. The overhead track may be manufactured of plastic or metal or some other material. The length of the overhead track may be longer or shorter than 24". The openings in the overhead track may be of various designs, such as an inverted comb with notches facing upward, which permit easy hanging and removal of the extendible parking device in order to adjust its position on the overhead track. The overhead track may be "T" shaped or some other shape rather than "L" shaped. The overhead track may be manufactured of plastic or metal. The scope of the invention should be determined not by the embodiment illustrated, but by the appended claims and their legal equivalents.

I claim:

1. An apparatus for helping a driver position a vehicle in a garage, said apparatus comprising an extendible parking guide and an overhead track:

a) said extendible parking guide having a plurality of rods wherein each of said plurality of rods includes a top end and a bottom end, and wherein said plurality of rods include a top rod, a bottom rod, a first set of intermediate rods having substantially the same length, and a second set of intermediate rods having varying lengths such that the length of each rod of said second set is different from each other of said second set and from said length of said first set, said top rod being located at a top of said guide and having a hook for supporting the guide from said overhead track, the bottom rod being located at a bottom of said guide for establishing a contact point with a vehicle for helping a driver position the vehicle, said top end of said bottom rod and each said top end of said first and second sets of rods includes an attachment means, said bottom end of said top rod and each said bottom end of said first and second sets of rods includes a connection means so that any of said attachment means is attachably connectable to any of said connection means, wherein the connection of a selection of said first and second sets of rods between said top and bottom rods can be arranged to correspond substantially to a distance between a ceiling in a garage and said contact point with said vehicle;

b) said overhead track having a mounting section and a hooking section, said mounting section being designed for mounting said overhead track to said ceiling, said hooking section having openings along its length and having a longitudinal axis arranged to be parallel to a path of movement of said vehicle, the hook of said top rod of said guide is positionable in any one of said openings in said hooking section such that the position of said extendible parking guide can correspond to said distance between said ceiling and said contact point with said vehicle.

2. The apparatus as defined in claim 1 wherein said attachment means and said connection means comprise male and female threads, respectively.

3. The apparatus as defined in claim 1 wherein said openings are oval in shape.

4. The apparatus as defined in claim 1 wherein said bottom rod is brightly colored.

5. The apparatus as defined in claim 1 wherein said bottom rod is reflective.

* * * * *